United States Patent [19]

Koob et al.

[11] 4,096,925

[45] Jun. 27, 1978

[54] ELEVATOR SYSTEM WITH DETECTOR FOR INDICATING RELATIVE POSITIONS OF CAR AND COUNTERWEIGHT

[75] Inventors: Robert W. Koob, Hopatcong; Alan L. Husson, Budd Lake, both of N.J.

[73] Assignee: Westinghouse Electric Corp., Pittsburgh, Pa.

[21] Appl. No.: 785,977

[22] Filed: Apr. 8, 1977

[51] Int. Cl.[2] ..... B66B 1/30; B66B 1/50

[52] U.S. Cl. ..... 187/29 R; 187/1 R

[58] Field of Search ..... 187/29 R, 1 R

[56] References Cited

U.S. PATENT DOCUMENTS

| | | | |
|---|---|---|---|
| 3,741,348 | 6/1973 | Caputo | 187/29 R |
| 3,783,978 | 1/1974 | Hamilton | 187/29 R |
| 3,791,490 | 2/1974 | Smith | 187/29 R |
| 3,792,759 | 2/1974 | Kirsch | 187/29 R |
| 3,815,710 | 6/1974 | Shrum | 187/29 R |
| 3,889,231 | 6/1975 | Tosato et al. | 187/29 R |
| 3,896,906 | 7/1975 | Shrum | 187/29 R |
| 3,945,470 | 3/1976 | Minns | 187/29 R |
| 4,011,928 | 3/1977 | Spear et al. | 187/29 R |

*Primary Examiner*—Bruce H. Stoner, Jr.
*Assistant Examiner*—Jeffrey V. Nase
*Attorney, Agent, or Firm*—D. R. Lackey

[57] ABSTRACT

An elevator system including an elevator car and counterweight mounted for guided vertical movement in the hoistway of a building. A magnetically operated detector mounted on the elevator car cooperates with a magnetic shield disposed in the hoistway to noiselessly provide signals which indicate when the elevator car and counterweight are in a predetermined collision zone where collision is possible should the counterweight deviate from its normal travel path. The detector also provides signals when the elevator car and counterweight are outside the collision zone, which signals indicate the relative positions of the elevator car and counterweight.

7 Claims, 7 Drawing Figures

ELEVATOR SYSTEM WITH DETECTOR FOR INDICATING RELATIVE POSITIONS OF CAR AND COUNTERWEIGHT

BACKGROUND OF THE INVENTION

1. Field of the Invention

The invention relates in general to traction elevator systems, and more specifically to a detector for indicating the relative positions of an elevator car and its counterweight in the hoistway of a building.

2. Description of the Prior Art

Damaging earthquakes are likely to occur in certain well-defined earthquake zones of the world. Elevator codes in these areas often specify one or more earthquake devices, such as a seismic switch actuated by building movement, a collision switch actuated by the car or counterweight when collision therebetween is imminent, or a derailment switch actuated by derailment of the counterweight. U.S. Pat. Nos. 3,783,978, 3,791,490, 3,792,759, 3,815,710 and 3,896,906 all relate to earthquake devices as applied to elevator systems. Application Ser. Nos. 584,431, now U.S. Pat. No. 4,011,928, 693,986, now abandoned, and 710,970, now U.S. Pat. No. 4,069,898, filed June 6, 1975, June 8, 1976, and Aug. 2, 1976, respectively, all of which are assigned to the same assignee as the present application, also relate to earthquake devices as applied to elevator systems.

Regardless of the type of earthquake detector utilized, certain of the elevator codes specify that if an elevator car is moving when an earthquake device is actuated the car shall either (a) slow to a speed not exceeding 150 FPM and proceed to the next floor in the direction of travel if the car will not pass the counterweight while doing so, or (b) stop and proceed to the next floor at a speed not greater than 150 FPM, in a direction away from the counterweight. Thus, it is necessary to know the relative positions of the car and counterweight in order to provide such intelligence for the floor selector when needed.

It is known (U.S. Pat. Nos. 3,815,710 and 3,896,906) to provide mechanical switches in the hoistway which are actuated by the elevator car and/or counterweight, and to provide brushes and contacts on an electromechanical floor selector (U.S. Pat. No. 3,791,490), to provide indications of the relative positions of the elevator car and counterweight. It would be desirable, however, to provide a new and improved elevator system which includes positional detector apparatus which is not dependent upon the accuracy of the floor selector, and which is not subject to the noise and wear of mechanically actuated switches in the hoistway.

SUMMARY OF THE INVENTION

Briefly, the present invention is a new and improved elevator system of the traction type which includes a position detector for the elevator car and counterweight which is not dependent upon the operation of the floor selector, and which operates reliably and noiselessly without maintenance due to wear, at any elevator speed. The detector includes first and second vertically spaced sources of electromagnetic radiation, which sources are horizontally spaced from first and second vertically spaced switching devices. The switching devices are in a first condition when they are not subjected to the electromagnetic radiation of the first and second sources, respectively, and in a second condition when they are. A shield member is disposed to shield the switching devices from the electromagnetic radiation when the elevator car and counterweight are in a predetermined positional relationship, such as in a zone where collision might occur should the counterweight deviate from its normal vertical travel path. Relative movement is provided between the detector and shield member in response to movement of the elevator car, such as by mounting the detector on the elevator car and mounting the shield in the hoistway. The switches are monitored by logic circuitry which develops signals relative to the conditions of the switches, and to the sequence in which the switches are operated, which signals indicate when the car and counterweight are in a collision zone, and when they are not in such zone, whether or not the car is above or below such zone.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
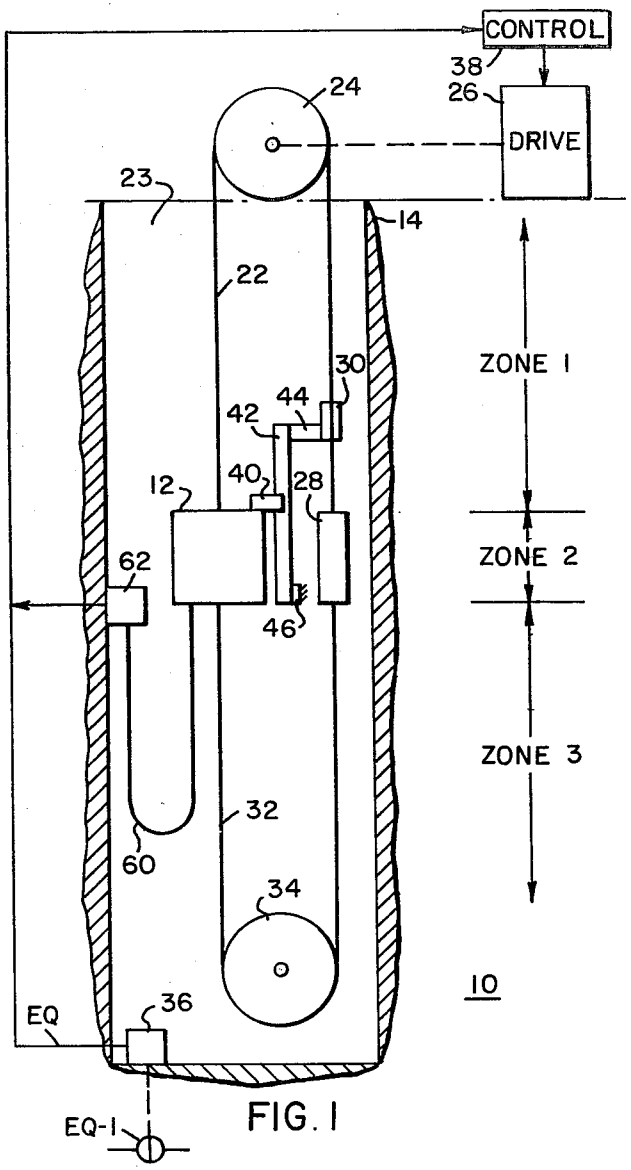
FIG. 1 is a diagrammatic view, in elevation, of an elevator system constructed according to the teachings of the invention.

Referring now to the drawings, and to FIG. 1 in particular, there is shown a traction elevator system 10 constructed according to the teachings of the invention. Elevator system 10 includes an elevator car 12 mounted for guided vertical movement via associated guide rails (not shown) relative to a structure 14 having a plurality of floors therein. The elevator car 12 is supported by wire ropes 22 in a hoistway 23, with the ropes 22 being reeved over a traction sheave 24 mounted on the shaft of a suitable drive machine 26, such as an electric motor. A counterweight 28 is mounted for guided movement via guide rails adjacent to the travel path of the elevator car 12. Only a portion 30 of one of the counterweight guide rails is illustrated in the FIGURE. The counterweight 28 is connected to the other ends of the wire ropes 22. Compensation cables 32 may interconnect the bottom of the elevator car 12 and counterweight 28 via a compensator sheave 34 disposed in the pit.

The elevator system 10 includes an earthquake detector device, which may be a seismic detector, a damage detector, such as a counterweight derailment detector, or the like. For purposes of example, it will be assumed that a seismic detector 36 provides a true (logic one) signal EQ and that it opens a normally closed contact EQ-1 when predetermined acceleration forces are applied to the building 14. The logic signal EQ and contact EQ-1 are part of the car control 38 which includes a floor selector for providing signals for the drive machine 26 relative to calls for elevator service requested by hall and car call push buttons (not shown).

The hereinbefore mentioned U.S. Pat. No. 3,792,759, which is assigned to the same assignee as the present application, discloses a two stage earthquake detector which may be used, with at least the first level including a seismic detector. This patent, and U.S. Pat. No. 3,741,348, which is referred to in U.S. Pat. No. 3,792,759, are hereby incorporated by reference into the present application in order to provide elevator control which may be used to slow and stop the car in response to an earthquake detector.

A position detector constructed according to the teachings of the invention includes a detector 40 and a shield member 42. The detector 40, which includes first and second sources of electromagnetic radiation and first and second switches responsive thereto, as will be hereinafter explained, is preferably mounted on the elevator car 12, such as on the top of the car. The shield member 42 is mounted in the hoistway 23 such that it is aligned to pass through a substantially U-shaped opening or slot in the detector 40 to separate or shield the switches from the sources of electromagnetic radiation as the elevator car travels through a predetermined portion of the hoistway. The shield member 42 is formed of a material which will prevent the electromagnetic radiation of the type emitted by the sources in detector 40 from passing therethrough. In a preferred embodiment, the sources of electromagnetic radiation are permanent magnets, and thus the shield member 42 would be an electromagnetic shield such as a thin, elongated plate member formed of a material having a high magnetic permeability, such as steel. It would also be possible to use visible, or invisible, light sources, with the switches being detectors thereof.

The shield member 42 has a vertical length dimension determined by the heights of the elevator car and counterweight. Its position in the shaft or hoistway 23 is substantially intermediate the travel path of the elevator car, with any offset from the horizontal centerline of the hoistway being due to the placement of the detector 40 at one end of the car, such as on the car top as illustrated. The shield member 42 may be mounted on one of the counterweight guide rails, such as guide rail 30, as illustrated at the upper end of the shield member 42 via bracket 44, or to some other suitable fixed point in the hoistway 23, such as illustrated at the lower end of the shield member 42 via bracket 46.

Figure 3:
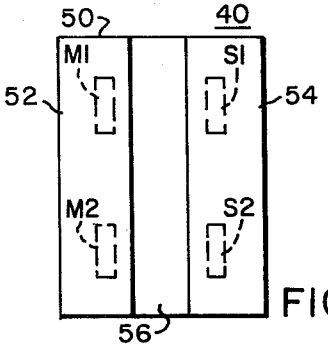
FIGS. 2, 3 and 4 are side and front elevational views, and a plan view, respectively, of a detector constructed according to the teachings of the invention, which may be used in the elevator system shown in FIG. 1.
Figure 4:
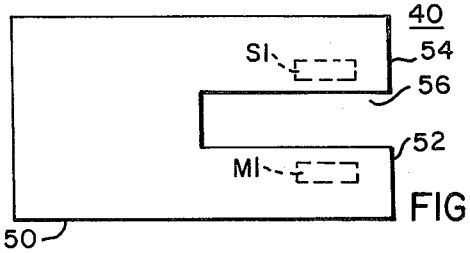
Figure 2:
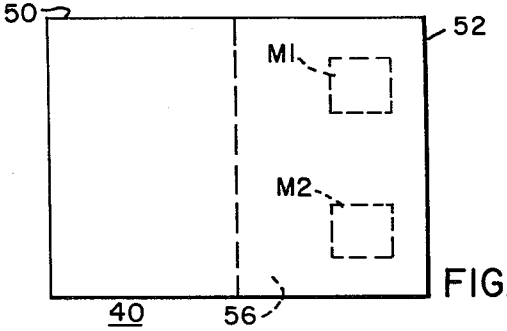

FIGS. 2, 3 and 4 are side and end elevational views, and a plan view, respectively, of a detector which may be used for detector 40 shown in FIG. 1. Detector 40 shown in FIGS. 2, 3 and 4 includes first and second vertically spaced and vertically aligned sources of electromagnetic radiation M1 and M2, preferably permanent magnets of the class of Alnico 5, and first and second vertically spaced and vertically aligned switching devices S1 and S2 of the type which are responsive to the electromagnetic radiation provided by the sources M1 and M2. If the sources M1 and M2 are permanent magnets, the first and second switches are preferably reed switches, such as single-pole, single-throw form A Hamlin magnetic reed switches.

The switches S1 and S2 are horizontally spaced from the sources M1 and M2, respectively, with the sources M1 and M2 and switches S1 and S2 being held in the proper dimensional relationships relative to one another by a suitable housing 50. The housing 50 includes first and second horizontally spaced arm portions 52 and 54 which define a vertically oriented slot 56 having a width dimension sufficient to receive the shield member 42 without danger of contact between the shield member 42 and the housing 50 as the elevator moves at rated speed through the hoistway.

Figure 5:
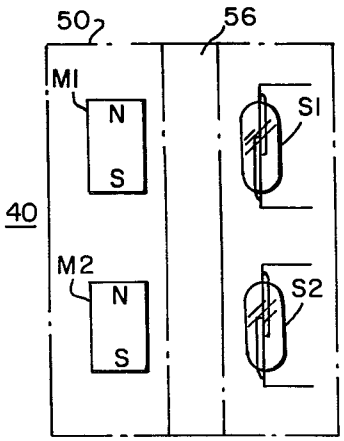

FIG. 5 is a schematic representation of the detector 40 in an elevational view similar to the elevational view of FIG. 3. As illustrated in FIG. 5, the detector 40, without the intervention of shield member 42, allows the magnetic fields of the sources M1 and M2 to operate their associated switches S1 and S2, respectively, to their closed positions.

Figure 6:
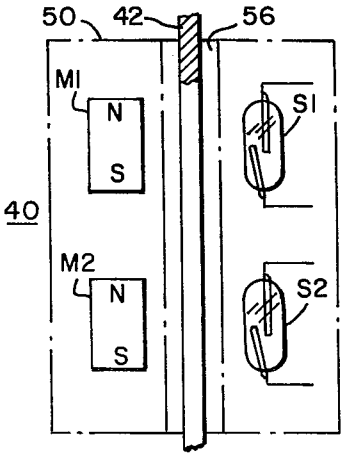
FIGS. 5 and 6 illustrate a detector constructed according to the teachings of FIGS. 2, 3 and 4, respectively illustrating the condition of the detector when it is not adjacent a shield member, and when it is adjacent a shield member.

FIG. 6 is a view of detector 40 similar to that shown in FIG. 5, except with the shield member 42 disposed in the slot 56. With the shield member 42 disposed between the sorces M1 and M2 and their associated switches S1 and S2, the switches are operated to their open positions.

When the elevator car 12 and counterweight 28 enter a predetermined collision zone, referred to as zone 2 in FIG. 1, the switches S1 and S2 will be shielded from the magnetic field provided by their associated sources and they will be operated to their open positions. If the elevator car is ascending as it leaves the collision zone (zone 2) to enter zone 1, switch S1 will close and then switch S2 will close, in that sequence. If the elevator car is descending as it leaves the collision zone to enter zone 3, switch S2 will close and then switch S1 will close, in that sequence. The open switches S1 and S2 are utilized to provide a signal that the car and counterweight are in the collision zone, and the sequence in which they close is utilized to provide signals which indicate whether the elevator car 12 is located above or below the counterweight 28 in the hoistway. These signals are sent by the elevator car 12 over the traveling cable 60 shown in FIG. 1, to a junction box 62 mounted in the hoistway 23, and from the junction box 62 to the car control 38.

Figure 7:
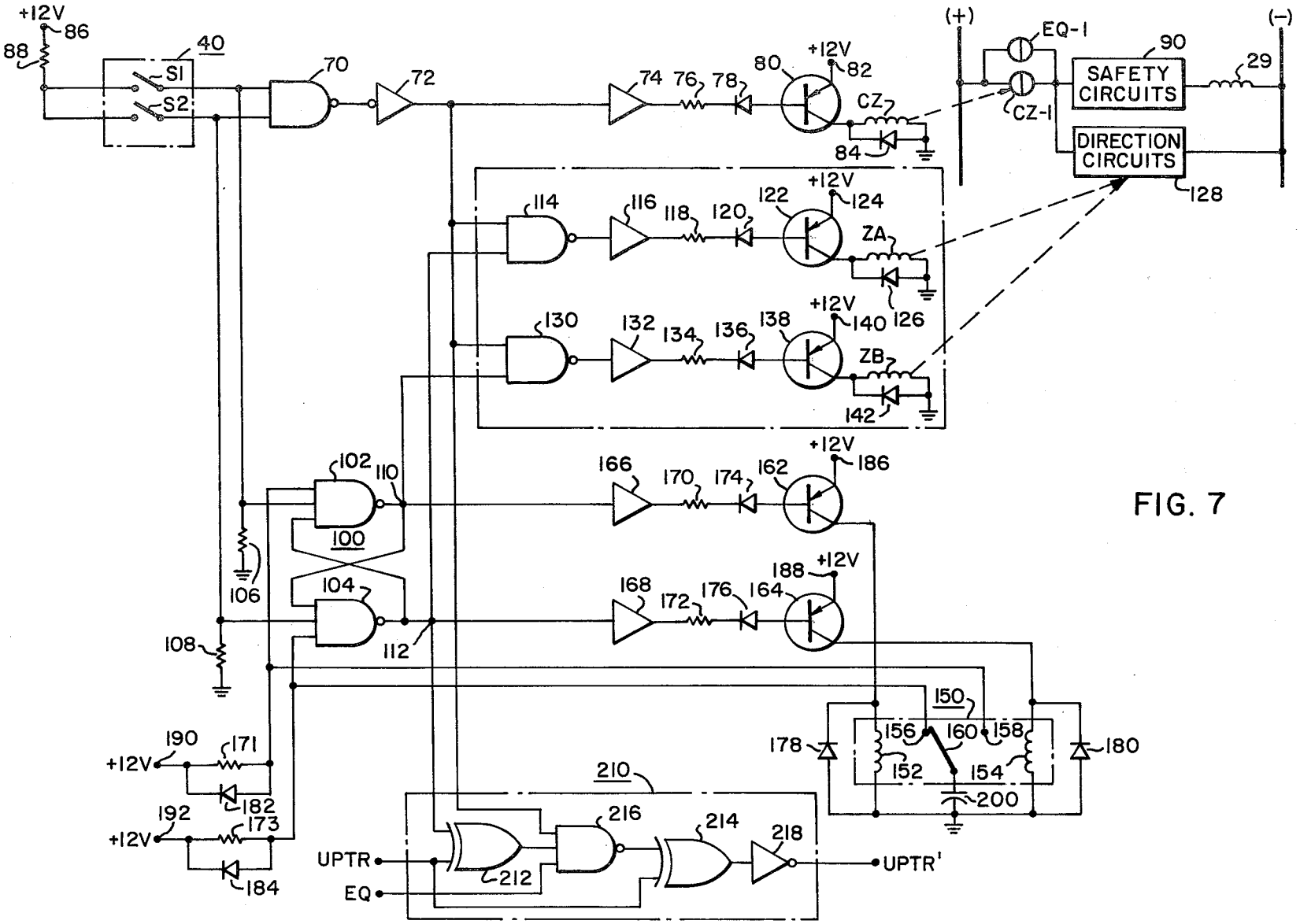
FIG. 7 is a schematic diagram of a logic and control circuit which may be used to develop control signals in response to the condition of the detector shown in FIGS. 1-6.

FIG. 7 is a schematic diagram which illustrates logic and control circuitry which may form a part of the car control 38 shown in FIG. 1. As hereinbefore stated, car control 38 is shown in greater detail in U.S. Pat. Nos. 3,792,759 and 3,741,348. The logic and control circuitry of FIG. 7 provides signals responsive to switches S1 and S2. The signals may be used in any desired manner, such as for use in complying with the various elevator earthquake codes.

More specifically, the logic and control circuitry of FIG. 7 includes a relay CZ which is energized when the elevator car and counterweight are in the collision zone (zone 2 in FIG. 1), and de-energized when they are outside the collision zone. Relay CZ is responsive to switches S1 and S2 via a dual input NAND gate 70, a NOT gate 72, a buffer amplifier 74, a resistor 76, a diode or rectifier 78, a PNP transistor 80, a unidirectional source of potential represented by terminal 82, and a diode 84. One terminal of each of the switches S1 and S2 is connected to a source of unidirectional potential, represented by terminal 86, via a resistor 88. Their other terminals provide the two signals to the dual input NAND gate 70. The output of NAND gate 70 is connected to the base of transistor 80 via NOT gate 72, buffer amplifier 74, resistor 76 and diode 78. Diode 78 is poled to conduct current away from the base. The emitter of transistor 80 is connected to unidirectional source 82 and its collector is connected to signal ground via the electromagnetic coil of relay CZ. Diode 84 is a free-wheeling diode connected across relay CZ to discharge the energy stored in the electromagnetic field of the coil when transistor 80 turns off.

When the elevator car 12 is outside zone 2, switches S1 and S2 will both be closed as illustrated in FIG. 5. Thus, NAND gate 70 applies a logic zero to NOT gate 72 which applies a logic one to the base of transistor 80. Transistor 80 is thus cut off, and relay CZ is de-energized.

When the elevator car 12 enters the collision zone, switches S1 and S2 both open as illustrated in FIG. 6, NAND gate 70 applies a logic one to NOT gate 72, and NOT gate 72 applies a logic zero to the base of transistor 80. Transistor 80 turns on and picks up relay CZ. Relay CZ, for example, may include a n.c. contact CZ-1 in the circuit of the safety relay 29. The serially connected safety circuits, shown generally at 90, normally energize the safety relay 29 by connecting it between positive and negative electrical buses. If any contact in the safety circuit 90 opens, the safety relay 29 drops out and the elevator car stops and remains in the stopped position until maintenance personnel correct the source of the malfunction. The n.c. contact EQ-1 of the earthquake device 36 shown in FIG. 1, and the n.c. contact CZ-1 may be connected in parallel, and this parallel circuit connected in the serial string of safety contacts 90. Normally, the opening of contact CZ-1 when the elevator car 12 enters the collision zone, will have no circuit effect. However, when the earthquake device 36 operates to open its contact EQ-1, the opening of contact CZ-1 will drop the safety relay 29. If the elevator car is moving at the time contacts CZ-1 and EQ-1 are simultaneously open, the elevator car will come to a stop and must be restarted by authorized personnel. This precaution is taken since danger of collision exists and further movement of the car without inspection by authorized personnel is not desired. If the car is stopped at the time that contacts CZ-1 and EQ-1 are simultaneously open, the car will not start until it is put back into operation by authorized personnel.

It should be noted that the NAND gate 70 OR's the two switches S1 and S2, causing relay CZ to pick up when any one or both of the switches S1 and S2 open.

The logic and control circuitry of FIG. 7 also includes a relay ZA which is energized only when the elevator car is above the collision zone, i.e., in zone 1 of FIG. 1, and a relay ZB which is energized only when the elevator car 12 is below the collision zone, i.e., in zone 3 of FIG. 1. Relays ZA and ZB are responsive to a flip-flop 100, which is set and reset according to the sequence in which switches S1 and S2 close as the elevator car 12 leaves the collision zone. Flip-flop 100 may include cross coupled NAND gates 102 and 104. The output terminal of switch S1 is connected to an input of NAND gate 102, and also to ground via resistor 106. The output terminal of switch S2 is connected to an input of NAND gate 104, and also to ground via resistor 108.

When the elevator car 12 is in the collision zone both switches S1 and S2 are open, applying logic zeros to both NAND gates 102 and 104, and thus both NAND gates output a logic one.

If the elevator car leaves the collision zone in the upward direction, switch S1 will close before switch S2, the output of NAND gate 102 goes low, and the output of NAND gate 104 will be held high. Thus, a terminal 110 at the output of NAND gate 102 will be a logic zero, and a terminal 112 at the output of NAND gate 104 will be high.

If the elevator car leaves the collision zone in the downward direction, switch S2 will close before switch S1 and output terminal 112 of flip-flop 100 will switch low and hold output terminal 110 high.

The "car above the counterweight" relay ZA is responsive to output terminal 112 of flip-flop 100 via a dual input NAND gate 114, a buffer amplifier 116, a resistor 118, a diode 120, a PNP transistor 122, a source of unidirectional potential represented by terminal 124, and a free-wheeling diode 126. Output terminal 112 of flip-flop 100 is connected to one input of NAND gate 114, and the other input of NAND gate 114 is connected to the output of NOT gate 72. The output of NAND gate 114 is connected to the base of transistor 122 via the buffer amplifier 116, resistor 118, and diode 120. Diode 120 is poled to conduct current away from the base. The emitter of transistor 122 is connected to the voltage source 124, and its collector is connected to ground via the electromagnetic coil of relay ZA. The free-wheeling diode 126 is connected across the coil of relay ZA.

When the elevator car leaves the collision zone and both switches S1 and S2 close, the output of NOT gate 72 will be a logic one, enabling NAND gate 114. Flip-flop 100 is set to one of its two positions prior to the enabling of NAND gate 114, as it is operated as soon as the first of the two switches closes. If the elevator car left the collision zone in the downward direction, terminal 112 will be low and NAND gate 114 will continue to apply a logic one to the base of transistor 122 when the output of NOT gate 72 goes high. If the elevator car leaves the collision zone in the upward direction, terminal 112 will be high and when the output of NOT gate 72 goes high, NAND gate 114 will go low to turn transistor 122 on and energize the "car above" relay ZA. Relay ZA has contacts in the direction circuits 128 which may be connected in any desired manner, such as to prevent the down direction relay from picking up when an earthquake detecting device has been actuated.

In like manner, the "car below the counterweight" relay ZB is responsive to output terminal 110 via a dual input NAND gate 130, a buffer amplifier 132, a resistor 134, a diode 136, a PNP transistor 138, a source of unidirectional potential represented by terminal 140, and a free-wheeling diode 142. Output terminal 110 of flip-flop 100 is connected to one input of NAND gate 130, and its other input is connected to the output of NOT gate 72. The output of NAND gate 130 is connected to the base of transistor 138 via the buffer amplifier 132, resistor 134, and diode 136. Diode 136 is poled to conduct current away from the base. The emitter of transistor 138 is connected to voltage source 140, and its collector is connected to ground via the electromagnetic coil of relay ZB. The free-wheeling diode 142 is connected across the coil of relay ZB.

When the elevator car leaves the collision zone and both switches S1 and S2 close, the output of NOT gate 72 will be a logic one, enabling NAND gate 130. Flip-flop 100 is set to one of its two conditions prior to the enabling of NAND gate 130, as it is operated as soon as the first of the two switches closes. If the elevator car leaves the collision zone in a downward direction, terminal 110 will be high and NAND gate 130 will apply a logic zero to the base of transistor 138 turning it on and energizing the "car below" relay ZB. Relay ZB has contacts in the direction circuit 128 which may be connected in any desired manner, such as to prevent the up direction relay from picking up when an earthquake detecting device has been actuated. If the elevator car leaves the collision zone in the upward direction, terminal 110 will be low and NAND gate 130 will continue to apply a logic one to the base of transistor 138 when the output of NOT gate 72 goes high, to keep transistor 138 turned off.

If electrical control power is interrupted for some reason while the elevator car is physically located in zone 1, or in zone 3, flip-flop 100 would lose its "memory", and when power returns both switches S1 and S2 would be closed and it would not be possible to determine which zone the car is located in. The logic and control circuitry of FIG. 7 automatically resets flip-flop 100 properly after return of electrical control power by operating a non-volatile memory in accordance with the output of flip-flop 100. The non-volatile memory automatically resets flip-flop 100 to the proper state after loss and return of electrical power.

More specifically, the non-volatile memory may include a latch relay 150 having electromagnetic coils 152 and 154, stationary contacts 156 and 158, and a movable contact 160. The non-volatile memory additionally includes PNP transistors 162 and 164, buffer amplifiers 166 and 168, resistors 170, 171, 172, and 173, diodes 174, 176, 178, 180, 182 and 184, a source of unidirectional potential represented by terminals 186, 188, 190 and 192, and a capacitor 200.

Output terminal 110 of flip-flop 100 is connected to the base of transistor 162 via buffer amplifier 166, resistor 170 and diode 174, the emitter of transistor 162 is connected to voltage source 186, and the collector is connected to one end of coil 152 of latch relay 150. The other end of coil 152 is connected to ground. Diode 178 is connected across coil 152.

Output terminal 112 of flip-flop 100 is connected to the base of transistor 164 via buffer amplifier 168, resistor 172, and diode 176, the emitter of transistor 164 is connected to source 188, and the collector is connected to one end of coil 154 of the latch relay 150. The other end of coil 154 is connected to ground. Diode 180 is connected across coil 154.

Stationary contact 156 of latch relay 150 is connected to an input of NAND gate 104 of flip-flop 100 and to source 192 via resistor 173. Diode 184 is connected across resistor 173 and is poled to conduct current towards source 192.

Stationary contact 158 of latch relay 150 is connected to an input of NAND gate 102 of flip-flop 100 and to source 190 via resistor 171. Diode 182 is connected across resistor 171 and is poled to conduct current towards source 190.

The movable contact 160 is connected to ground via capacitor 200.

Latch relay 150 operates movable contact 160 to engage stationary contact 156 when coil 152 is energized, and the movable contact remains in this position, notwithstanding removal of electrical power, until coil 154 is energized to operate the movable contact to engage stationary contact 158. Thus, when output terminal 110 of flip-flop 100 is a logic zero and output terminal 112 is a logic one, indicating the elevator car is above zone 2, i.e., in zone 1, transistor 162 is turned on to energize coil 152 of latch relay 150 and cause movable contact 160 to engage stationary contact 156. When output terminal 112 of flip-flop 100 is a logic zero, indicating the elevator car 12 is below zone 2, i.e., in zone 3, transistor 164 is turned on to energize coil 154 and cause movable contact 160 to engage stationary contact 158. Thus, the latch relay 150 follows the state of flip-flop 100, with the capacitor 200 being connected to an input of NAND gate 104 of flip-flop 100 when the car is located in zone 1, and with capacitor 200 being connected to an input of NAND gate 102 of flip-flop 100 when the elevator car is located in zone 3.

If the electrical power supply is interrupted for some reason, diode 182, or diode 184, will discharge capacitor 200. First, let it be assumed that when the electrical power is interrupted that the movable contact 160 is in the position illustrated in FIG. 7. When power returns, the input to NAND gate 102, which is connected to source 190, will immediately go high, but the capacitor 200 will momentarily hold the input of NAND gate 104 which is connected to source 192 low, as capacitor 200 has a finite charging time. Thus, flip-flop 100 will automatically be set with terminal 112 high and terminal 110 low, which will energize the "car above" relay ZA.

If power is interrupted with movable contact 160 engaged with the stationary contact 158, flip-flop 100 will be set with output terminal 112 low and output terminal 110 high, which will energize the "car below" relay ZB.

In the event the car direction circuits are of the solid state type, instead of the electromagnetic relay type, such as the solid state floor selector shown in U.S. Pat. No. 3,750,850, which is assigned to the same assignee as the present application, relays ZA and ZB may be replaced by solid-state circuitry which is responsive to flip-flop 100. In U.S. Pat. No. 3,750,850 a travel direction signal UPTR is provided by the floor selector which is at the logic one level when the selected travel direction is up, and at the logic zero level when the selected travel direction is down. FIG. 7, by way of example, illustrates a logic circuit 210 which is responsive to a true "earthquake detected" signal EQ from the earthquake detector device 36 shown in FIG. 1, and also to the conditions of flip-flop 100 and switches S1 and S2. If the elevator car 12 is located in zone 1, or in zone 3, and the selected travel direction signal UPTR selects a travel direction in which the car would travel towards the counterweight, logic circuit 210 automatically changes the logic level of signal UPTR to provide the proper travel direction. The output of logic circuit 210 is referred to as signal UPTR' in order to indicate the signal UPTR may be modified.

Logic circuit 210 includes XOR gates 212 and 214, a three input NAND gate 216, and a NOT gate 218. One input of XOR gate 212 is connected to output terminal 112 of flip-flop 100 and its other input is connected to receive the travel direction signal UPTR. The output of XOR gate 212 is connected to an input of NAND gate 216, another input is connected to an output of NOT gate 72, and the remaining input is connected to receive the earthquake signal EQ. The output of NAND gate 216 is applied to one input of XOR gate 214 and its other input is connected to receive the travel direction signal UPTR. The output of XOR gate 214 is connected to output terminal UPTR' via NOT gate 218.

If the elevator car 12 is located in zone 1 with the travel direction signal UPTR requesting up travel (UPTR = 1) when the earthquake signal EQ goes true (logic one), the output of XOR gate 212 will be low, the output of NAND gate 216 will be high, the output of XOR gate 214 will be low, and NOT gate 218 will apply a logic one to output terminal UPTR'. Thus, the travel direction signal will not be changed since it was already requesting that the car travel away from the counterweight. If, in this same situation, signal UPTR is a logic zero, i.e., requesting down travel, the output of XOR gate 212 will be high, the output of NAND gate 216 will be low, and since the two inputs to XOR gate 214 are both low, the output of XOR gate 214 will be low and NOT gate 218 will apply a logic one to output terminal UPTR', setting the car for up travel. Thus, if the elevator car is moving when signal EQ goes high, it can be stopped in response to the high speed EQ, and circuit 210 will automatically set the car for travel away from the counterweight.

If the output terminal 112 is a logic zero when signal EQ goes high, indicating the elevator car is in zone 3 and should not be set for up travel, a signal UPTR at the logic one level will be changed to the logic zero level, and the signal UPTR at the logic zero level will be unchanged.

When the elevator car is located in zone 2, and also when the earthquake signal EQ is low, the logic circuit 210 has no circuit effect on signal UPTR, as the output of NAND gate 216 will be held high, applying a logic one to one of the inputs of XOR gate 214. This allows signal UPTR to appear unchanged at output terminal UPTR'.

In summary, there has been disclosed a new and improved elevator system which noiselessly and reliably provides signals which indicate when the elevator car and counterweight are in a zone where collision might occur should the counterweight deviate from its normal travel path, and it also provides signals which indicate the relative positions of the elevator car and counterweight, when the elevator car and counterweight are outside of the collision zone. The new and improved positional detector retains its memory in the event of a power interruption, and since the detector is not related to the floor selector, it may be used with any type of floor selector, and is not subject to inaccuracy, such as due to an out-of-step floor selector.

We claim as our invention:

1. An elevator system, comprising:

a building having a plurality of floors and a hoistway, an elevator car, a counterweight, said elevator car and counterweight being mounted for guided movement in adjacent vertical travel paths in the hoistway of said building to serve the floors therein, detector means for determining the relative positions of said elevator car and counterweight, said detector means including first and second vertically spaced sources of electromagnetic radiation, and first and second vertically spaced switching devices operable from a first condition to a second condition in response to electromagnetic radiation from said first and second sources of electromagnetic radiation, respectively, shielding means, said detector means and said shielding means being mounted for relative motion responsive to movement of said elevator car, said shielding means shielding said first and second switching devices from the electromagnetic radiation of said first and second sources when the counterweight and elevator car bear a predetermined positional relationship to one another, with said first and second switching devices being in their first conditions when shielded from the electromagnetic radiation, first means responsive to at least one of the first and second switching devices being in a predetermined one of its conditions for providing a signal indicating the elevator car and counterweight are within a predetermined zone where collision could occur in the event the counterweight is outside of its normal travel path, said first and second switching devices being sequentially operated by the shielding means as the elevator car and counterweight leave the predetermined zone, and second means responsive to the sequence for indicating the relative positions of the elevator car and counterweight.

2. The elevator system of claim 1 wherein the detector means is mounted on the elevator car and the shielding means is mounted in the hoistway.

3. The elevator system of claim 1 wherein the second means provides a first signal when the elevator car is above the counterweight, and a second signal when the elevator car is below the counterweight.

4. The elevator system of claim 1 wherein the first means provides the signal indicating the elevator car and counterweight are within the predetermined collision zone when at least one of the first and second switching devices is in its first condition, and the second means is responsive to the sequence in which the first and second switching devices are operated from their first to their second conditions for indicating the relative positions of the elevator car and counterweight when they are outside the collision zone.

5. The elevator system of claim 1 wherein the second means provides a first signal when the elevator car is above the collision zone, and a second signal when the elevator car below the collision zone.

6. The elevator system of claim 5 including memory means for storing the latest first and second signals, and wherein the second means is responsive to said memory means for determining which of the first and second signals should be provided in the event the second means should lose either of the first and second signals.

7. The elevator system of claim 6 wherein the first and second sources of electromagnetic radiation are permanent magnets, the first and second switching devices responsive thereto are reed switches, the second means includes a volatile memory, and the memory means is a nonvolatile memory.

* * * * *